United States Patent [19]

Boyd

[11] Patent Number: 4,589,692

[45] Date of Patent: May 20, 1986

[54] PORTABLE DOOR LOCK

[75] Inventor: Elihu K. Boyd, Rising Sun, Md.

[73] Assignees: David R. Hamilton; Barbara J. Hamilton, both of Oxford, Pa.

[21] Appl. No.: 620,340

[22] Filed: Jun. 13, 1984

[51] Int. Cl.[4] ..... E05C 19/18

[52] U.S. Cl. ..... 292/297; 292/298

[58] Field of Search ..... 292/297, 298, DIG. 46, 292/DIG. 47, 289, 290

[56] References Cited

U.S. PATENT DOCUMENTS

| | | | |
|---|---|---|---|
| 618,844 | 2/1899 | Corey | 292/297 |
| 863,091 | 8/1907 | Prindle | 292/297 |
| 946,437 | 1/1910 | Helle | 292/298 |
| 960,521 | 6/1910 | Early | 292/298 |
| 961,880 | 6/1910 | Miller | 292/297 |
| 979,167 | 12/1910 | Hutchinson | 292/298 |
| 1,053,002 | 2/1913 | Boring | 292/297 |
| 1,154,822 | 9/1915 | Willard | 292/298 |
| 1,390,009 | 9/1921 | Arledge | 292/297 |
| 1,780,941 | 11/1930 | Pineo | 292/298 |
| 4,169,619 | 10/1979 | McCracken | 292/297 X |

FOREIGN PATENT DOCUMENTS

| | | | |
|---|---|---|---|
| 256831 | 1/1928 | Italy | 292/298 |

*Primary Examiner*—Robert L. Wolfe
*Assistant Examiner*—Russell W. Illich
*Attorney, Agent, or Firm*—Leonard Bloom

[57] ABSTRACT

A portable door lock has a relatively-thin sheet-metal locking strap that fits between the door and the jamb. The strap has a fixed bolt on one end that is received in the recessed keeper in the jamb, with the door in the open position. The door is closed over the strap; and a locking dog pivotably mounted on the other end of the strap, is pivoted towards the door such that the dog partially overlaps the strap, and such that the outer face of the dog engages the inner side of the door, thereby preventing the door from being opened from the outside. The outer face of the dog may be arcuately formed to accommodate different door thicknesses within a given range, and the outer arcuate face may have a frictional layer for non-slip purposes and to prevent any marring of the door finish. A retainer may be provided over the dog and the strap to retain the portable door lock in its locking position.

10 Claims, 12 Drawing Figures

PORTABLE DOOR LOCK

The present invention constitutes a portable door lock, and more particularly, to a portable door lock that may be used in the home or when traveling.

BACKGROUND OF THE INVENTION

In the prior art of which I am aware, various door locks and alarms have been disclosed which are intended to safeguard the occupants of a room or a home. These prior art devices are usually heavy and cumbersome, difficult to understand and manipulate, and/or costly to manufacture or service.

SUMMARY OF THE INVENTION

Accordingly, it is an object of the present invention to alleviate the disadvantages and deficiencies of the prior art by providing a portable door lock which is simple and effective, yet economical to manufacture, thereby facilitating its widespread marketing and distribution.

It is another object of the present invention to provide a portable door lock which is readily understood, easy to install, and accommodates either right or left handed doors.

It is yet another object of the present invention to provide a portable door lock in the form of a complete integral unit, such that there are no keys, separate chains or other loose pieces that may become lost or mislaid.

It is a further object of the present invention to provide a portable door lock that, once installed, may be removed quickly and easily, which is especially important in the event of an emergency.

In accordance with the teachings of the present invention, there is illustrated and described herein a preferred embodiment of the portable door lock, in which a relatively-thin locking strap is adapted to be fitted between a door and its cooperating jamb. The strap has first and second end portions, and bolt means are carried on the first end portion of the strap. The bolt means is adapted to be received within a recess in the keeper on the jamb when the door is in its open position. A locking dog or brace is pivotably mounted on the second end portion of the strap about an axis which is transverse to the plane of the strap. The dog has an unlocked position in which it is normally pivoted away from the strap when the door is in its open position. After the door is closed over the strap, such that the conventinal bolt on the door is retracted, the dog may be pivoted towards the strap and into its locking position such that the dog overlaps the strap, and such that the dog engages the inner side of the door, thereby preventing the door from being opened from its outer side. To release the lock, the dog is simply pivoted away from the strap, such that the door may be opened and the portable door lock removed.

In accordance with the further teachings of the present invention, the dog has an arcuate face outwardly of its pivotable mounting on the strap. This arcuate face engages the inner side of the door and will accommodate doors of various thickness. A frictional surface is provided on the arcuate face of the dog, so as to provide a non-slip locking position of the dog, yet without marring the finish on the inner side of the door. A retainer is also provided to maintain the dog in its locking position and prevent it from separating relative to the strap.

These and other objects of the present invention will become apparent from a reading of the following specification taken in conjunction with the enclosed drawings.

GENERAL DESCRIPTION OF A PREFERRED EMBODIMENT

Figure 1:
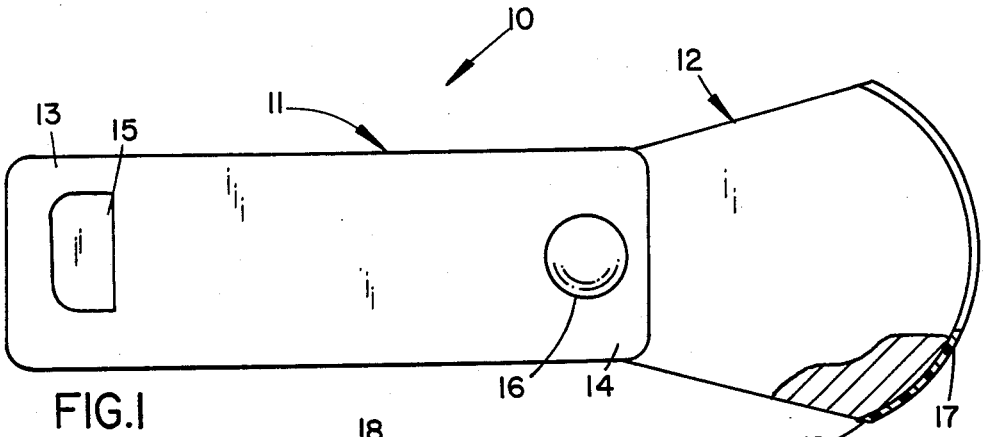
FIG. 1 is a front elevation of the portable door lock of the present invention in its unlocked position, the locking dog being shown pivoted away from the locking strap.
Figure 2:
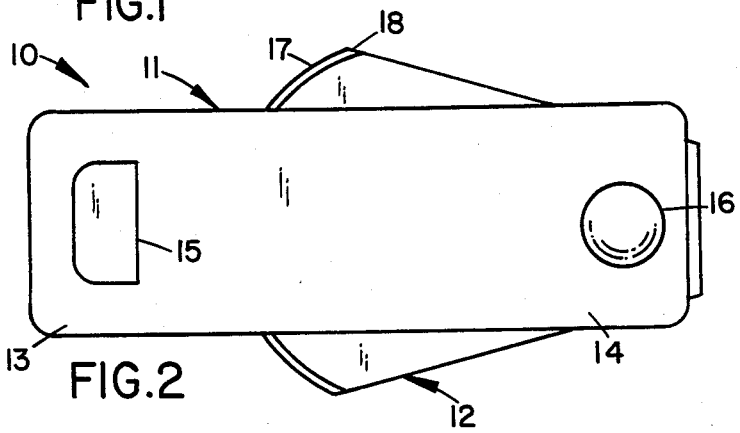
FIG. 2 corresponds substantially to FIG. 1, but shows the portable door lock in its locking position in which the dog partially overlaps the strap.

With reference to FIGS. 1–5, the portable door lock 10 comprises a locking plate or strap 11 and a pivotal locking dog or brace 12. The strap has a first end portion 13 and a second end portion 14. A fixed bolt means 15 is carried in the front end portion of the strap. Preferably, the bolt means is a solid piece which is brazed to the strap and has a configuration similar to the conventional bolt on the door. The second end portion of the strap is pivoted to the dog by a rivet 16 or other suitable means. The dog has an outer arcuate face 17 which is preferably covered with a rubber or other frictional layer 18. Preferably, the strap is formed from relatively-thin slightly-flexible sheet metal, while the dog is substantially thicker than the strap and is preferably formed from an aluminum plate.

The door 19 is of the conventional design and is provided with a retractable bolt 20 that is part of the conventional knob (not shown), and the door cooperates with a conventional jamb 21. The jamb has a keeper 22 provided with a recess 23 for normally receiving the bolt in the door.

Figure 3:
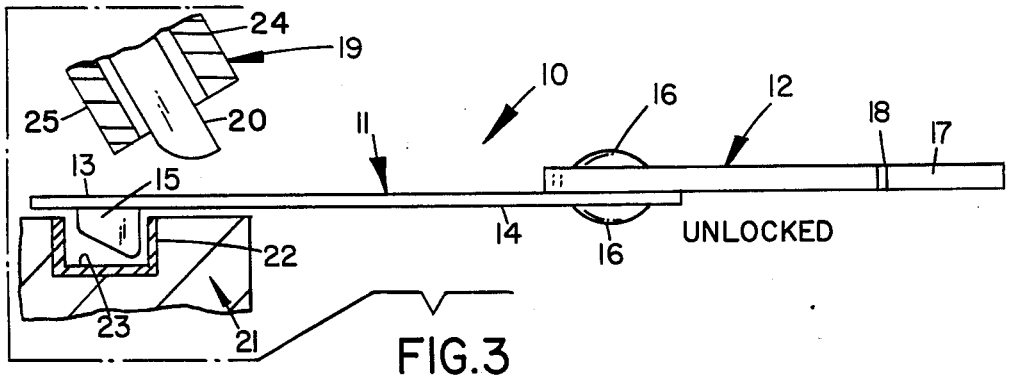
FIG. 3 is a top plan view of the portable door lock in its unlocked position in relation to a door and jamb, in which the door is in its open position, the bolt means on the strap is received within the recess in the keeper in the jamb, and the dog is pivoted away from the strap.
Figure 4:
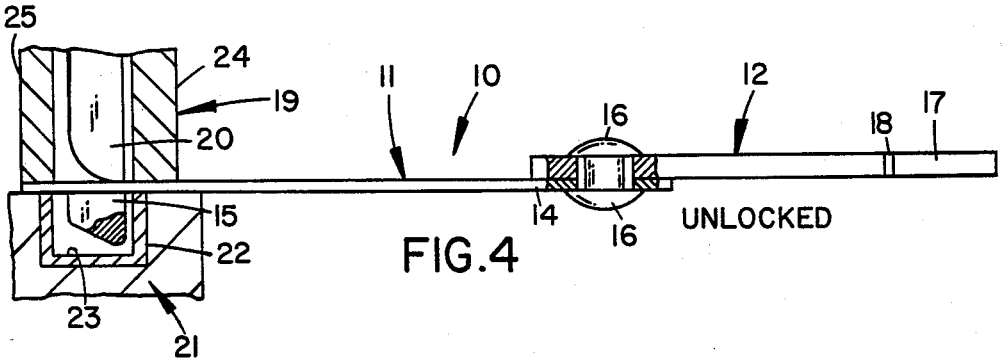
FIG. 4 corresponds substantially to FIG. 3, but shows the door closed over the strap, the conventional bolt on the door being retracted within the door, and the dog still being positioned away from the door.
Figure 5:
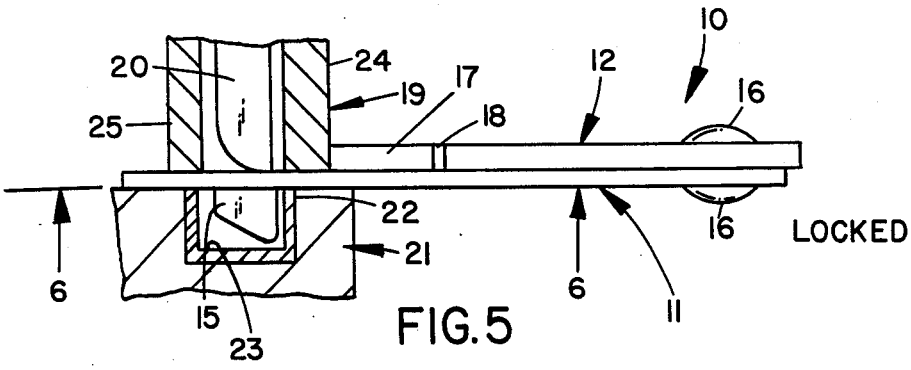
FIG. 5 corresponds substantially to FIG. 4, but shows the dog pivoted towards the door, such that the arcuate face on the dog engages the inner face of the door, thereby preventing the door from being opened from the outside.

In operation, the strap 11 is positioned between the door and jamb, when the door is in its open position as shown in FIG. 3, such that the bolt means 15 in the strap 11 is received within the recess 23 in the keeper on the jamb. The door is then closed over the strap, as shown in FIG. 4, such that the conventional bolt in the door is retracted within the door. The dog 12 is then pivoted towards the door such that the dog partially overlaps the strap as shown in FIG. 5, and such that the outer face of the dog engages the inner side 24 of the door, thereby preventing the door from being opened from its outer side 25. This is the locking position of the portable door lock of the present invention.

In this locking position, the frictional layer 18 on the arcuate face 17 of the locking dog 12 will prevent the dog from slipping up or down, or sideways, and will protect the finish of the inner side of the door against an undesired marring.

To release the portable door lock, the dog 12 is simply pivoted away from the strap 11 and moved back towards its position shown in FIG. 3. The door may then be opened and the portable door lock removed. This is especially important in the event an emergency occurs and a quick exit is imperative.

Figure 6:
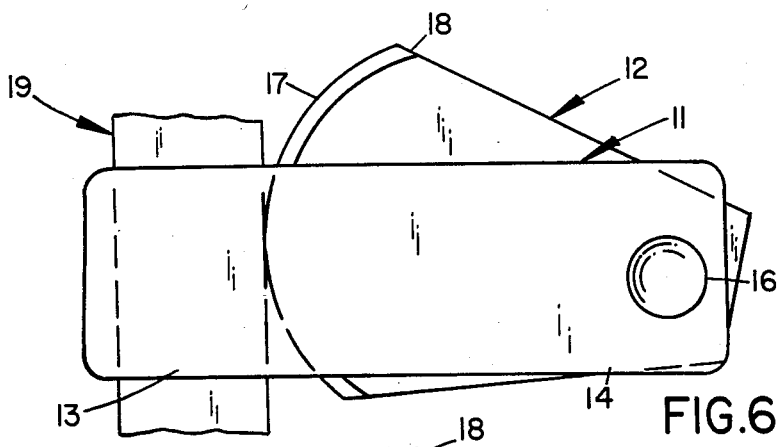
FIG. 6 is a view taken along the lines 6—6 of FIG. 5, the dog being shown in its locking position.
Figure 7:
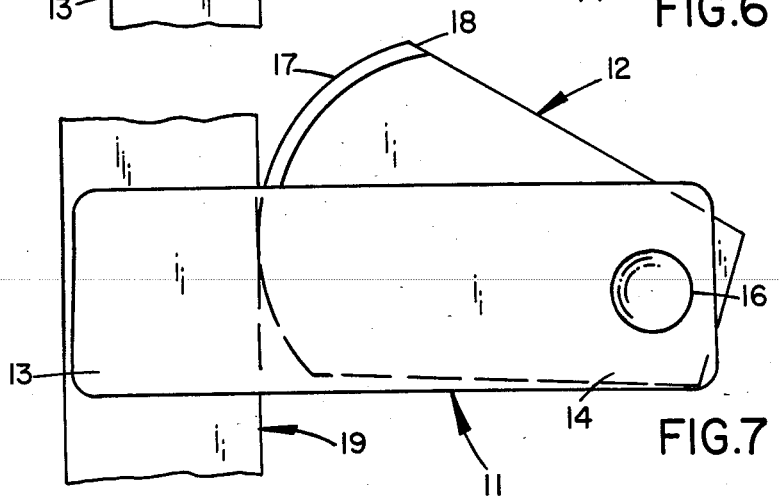
FIG. 7 corresponds substantially to FIG. 6, but shows the portable door lock applied to a somewhat thicker door.
Figure 8:
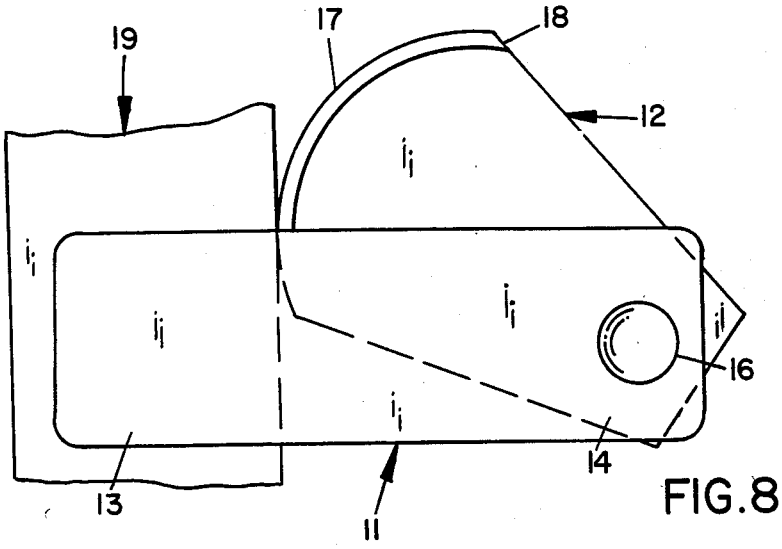
FIG. 8 corresponds substantially to FIG. 7, but shows the portable door lock applied to a still thicker door.

FIGS. 6–8 illustrate schematically the portable door lock in its locking position with respect to three different-sized doors. FIG. 6 is for a 1½" door; FIG. 7 for a 1¾" door, and FIG. 8 for a 2" door. The design of the dog, and more particularly its arcuate face, will accommodate these different door thicknesses within a given range covering most applications. Moreover, it will be appreciated that the illustrations of FIGS. 6–8 are exemplary only, and that any size door within a given range may be locked securely with the portable door lock of the present invention.

It will also be appreciated that the portable door lock of the present invention is reversible from the position shown in the drawings, that is, it may be used with either right or left-handed doors.

The portable door lock of the present invention is a complete integral unit; there are no keys, separate chains or other loose pieces that may become lost or mislaid, and this is another important feature of the present invention.

Figure 10:
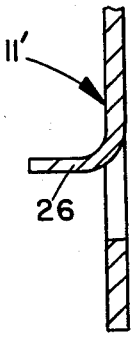
FIG. 10 is a section view, taken along the lines 10—10 of FIG. 9.
Figure 9:
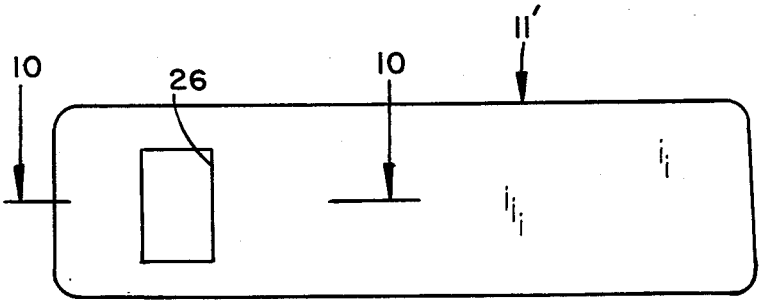
FIG. 9 is a top plan view of an alternate embodiment of the locking strap used in the portable door lock of the present invention.

FIGS. 9 and 10 illustrate an alternate embodiment, wherein the strap 11[1] has a lanced-out tab 26 to simulate the bolt means 15 of the FIG. 1 embodiment.

Figure 11:
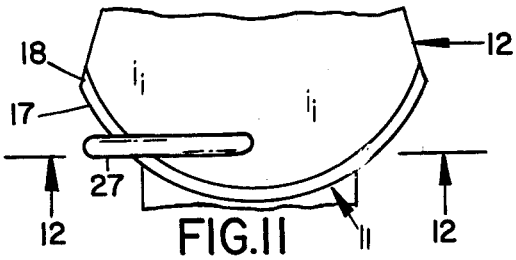
FIG. 11 illustrates another alternate embodiment in which a retainer is carried by the dog and fits over the dog and the strap for maintaining the portable door lock in its locking position.
Figure 12:
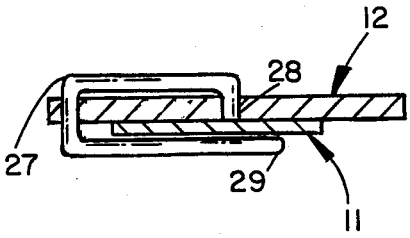
FIG. 12 is a section view, taken across the lines 12—12 of FIG. 11.

FIGS. 11 and 12 illustrate another alternate embodiment, wherein a retaining means is provided over the strap and the dog. Preferably, the retaining means comprises a U-shaped wire-formed retainer 27 having one end pivotably received in a hole 28 in the dog. The retainer is wrapped around the dog and has its other, free end 29 spread sufficiently from the face of the dog to receive the strap therebetween. The retainer prevents the dog from slipping up or down or sideways relative to the strap.

The portable door lock of the present invention is simple, effective and reliable; may be manufactured economically from readily available materials; and may be readily understood and installed without requiring extensive skill or instruction. These are significant advantages heretofore not available.

Obviously, many modifications may be made without departing from the basic spirit of the present invention. Accordingly, within the scope of the appended claims, the invention may be practiced other than specifically described herein.

I claim:

1. A portable lock for a door of the type cooperating with a jamb, the door having inner and outer sides and further having a retractable bolt, and the jamb having a keeper provided with a recess to receive the retractable bolt, and wherein the lock is reversible for right-hand and left-hand doors and will accommodate various thicknesses of doors within a given range; said lock comprising a relatively-thin locking strap adapted to be fitted between the door and the jamb, the strap having respective first and second end portions, bolt means on the first end portion of the strap and adapted to be received within the recess in the keeper when the door is in its open position, and a locking dog pivotably mounted on the second end portion of the strap about a pivot axis transverse to the plane of the strap, the dog having an outer arcuate face which is eccentric with respect to the pivot axis, and the dog being substantially symmetrical about a line drawn from the pivot axis to the outermost portion of the arcuate face, thereby separating the arcuate face into respective curved portions on either side of the symmetrical line, one of the portions engaging the door when the lock is used on a right-hand door, and the other portion engaging the door when the lock is used on a left-hand door.

2. The portable door lock of claim 1, wherein the strap is made from sheet metal and is slightly flexible, and wherein the dog is substantially thicker than the strap and is substantially rigid.

3. The portable door lock of claim 1, wherein the dog has an arcuate face outwardly of its pivotable mounting to the strap, whereby the arcuate face accommodates various door thicknesses as the dog partially overlays the strap in its locking position.

4. The portable door lock of claim 3, wherein the outer face of the dog is provided with a frictional layer.

5. The portable door lock of claim 1, wherein the bolt means on the strap comprises a substantially-solid bolt secured to the strap, the bolt having substantially the same configuration as the retractable bolt on the door.

6. The portable door lock of claim 1, wherein the bolt means on the strap comprises a lanced-out tab.

7. The portable door lock of claim 1, further including retaining means for retaining the dog on the strap in its locking position.

8. The portable door lock of claim 7, wherein the retaining means comprises a U-shaped retainer having one end pivotably received in a hole in the dog, the retainer being wrapped around the dog, and retainer having its other free end spaced from the dog and adapted to receive the strap therebetween.

9. A portable lock for a door of the type cooperating with a jamb, the door having inner and outer sides and further having a retractable bolt, and the jamb having a keeper provided with a recess to receive the retractable bolt on the door, and wherein the lock is reversible for right-hand and left-hand doors and will accommodate various thicknesses of doors within a given range; said lock comprising a relatively-thin locking strap adapted to be fitted between the door and the jamb, the strap having respective first and second end portions, bolt means on the first end portion of the strap and adapted to be received within the recess in the keeper when the door is in its open position, a locking dog pivotably mounted on the second end portion of the strap about a pivot axis transverse to the plane of the strap, whereby the dog has an unlocked position in which the dog is normally pivoted away from the strap when the door is in its open position, the dog having an arcuate face outwardly of its pivotable mounting to the strap, the arcuate face being provided with a frictional layer, and wherein the outer arcuate face of the dog is eccentric with respect to the pivot axis, the dog being substantially symmetrical about a line drawn from the pivot axis to the outermost portion of the arcuate face, thereby separating the arcuate face into respective curved portions on either side of the symmetrical line, one of the portions engaging the door when the lock is used on a right-hand door, and the other portion engaging the door when the lock is used on a left-hand door whereby after the door is closed over the strap such that the bolt on the door is retracted, the dog may be pivoted towards the strap and into its locking position such that the dog overlaps the strap, and such that the frictional surface on the arcuate face of the dog engages the inner side of the door, thereby preventing the door from being opened form its outer side, and means for retaining the dog in its locking position.

10. A portable lock for a door of the type cooperating with a jamb, the door having inner and outer sides and further having retractable bolt, and the jamb having a keeper provided with a recess to receive the retractable bolt, and wherein the lock is reversible for right-hand and left-hand doors and will accommodate various thicknesses of doors within a given range; said lock comprising a complete, integral unit without loose pieces and including a relatively-thin slightly-flexible locking strap adapted to be fitted between the door and the jamb, the strap having respective first and second end portions, bolt means on the first end portion of the strap and adapted to be received within the recess in the keeper when the door is in its open position, a locking dog pivotably mounted about an axis on the second end portion of the strap, the dog having an outer arcuate face which is eccentric with respect to the pivot axis, and the dog being substantially symmetrical about a line drawn from the pivot axis to the outermost portion of the arcuate face, thereby separating the arcuate face into respective curved portions on either side of the symmetrical line, one of the portions engaging the door when the lock is used on a right-hand door, and the other portion engaging the door when the lock is used on a left-hand door, whereby the dog has an unlocked position in which the dog is normally moved away from the door when the door is in its open position, and whereby, after the door is closed over the strap, such that the bolt on the door is retracted, the dog may be moved relative to the strap and into its locking position, wherein the dog engages the inner side of the door and forms a brace between the door and the strap, thereby preventing the door from being opened from its outer side, and wherein the dog may be easily and quickly moved away from the strap and into its unlocked position in the event of an emergency situation.

* * * * *